United States Patent [19]

Yasuda et al.

[11] 4,320,643

[45] Mar. 23, 1982

[54] METHOD AND APPARATUS FOR CORRECTING ASYMMETRICAL CONDITION IN ROLLING MILL

[75] Inventors: Ken-ichi Yasuda; Shigeru Shida, both of Hitachi, Japan

[73] Assignee: Hitachi, Ltd., Tokyo, Japan

[21] Appl. No.: 111,816

[22] Filed: Jan. 14, 1980

[30] Foreign Application Priority Data

Jan. 17, 1979 [JP] Japan ..... 54-2961

[51] Int. Cl.[3] ..... B21B 37/00; B21B 31/18; B21B 13/14

[52] U.S. Cl. ..... 72/8; 72/247; 72/19

[58] Field of Search ..... 72/8, 19, 247

[56] References Cited

U.S. PATENT DOCUMENTS 3,587,263 6/1971 McCarthy ..... 72/8

3,818,743 6/1974 Kajiwara et al. ..... 72/247 X

*Primary Examiner*—Milton S. Mehr

*Attorney, Agent, or Firm*—Thomas E. Beall, Jr.

[57] ABSTRACT

A rolling mill in which rolls are displaced in axial direction thereof during operation in dependence on the width, profile and the like factors of a material being rolled. A real rolling load difference is derived by removing a rolling load change components due to a moment produced upon displacement of the rolls from a difference in the rolling load between an operating side and a driving side of the rolling mill, and is utilized for correcting the rolling asymmetry.

6 Claims, 9 Drawing Figures

METHOD AND APPARATUS FOR CORRECTING ASYMMETRICAL CONDITION IN ROLLING MILL

The present invention relates to a method of correcting asymmetrical conditions such as meandering movement, unequal rolling in the widthwise direction of a material to be rolled or the like undesirable conditions in a rolling mill incorporating axially movable rolls and also concerns an apparatus for carrying out the method.

In recent years, the requirement for accuracy in thickness of rolled product is becoming severer and severer. To meet such requirement, the accuracy in thickness in the longitudinal direction of rolled materials has been increased to an appreciable extent owing to the development of an automatic thickness control technique. However, there is at present available no means for effectively controlling the thickness in the widthwise direction of the rolled material with a reasonable accuracy. Certainly, a work roll bending method has been developed and adopted in a four-high rolling mill as a measure to control the flatness in the widthwise direction of the rolled material with considerably good results. However, in the conventional roll bending technique, the flatness controlling effect or so-called flatness correcting capability is limited and is particularly unsatisfactory when the width of materials to be rolled varies largely, with the result that satisfactory control can not be attained.

Recently, as an attempt to solve the problem described above, there has been developed a modern rolling mill in which intermediate rolls are disposed, respectively, between a work roll and a back-up roll in a form of a six-high mill, wherein the intermediate rolls are adjustably displaced in the axial directions thereof in dependence on the widths as well as profiles of the materials to be rolled, to thereby enhance the flatness correcting capability of the roll bending apparatus. For example, reference is to be made to Japanese Patent Publication No. 19510/1975, U.S. Pat. No. 3,818,743, British Pat. No. 1351074 and German Patent Publication No. 2206912. On the other hand, an apparatus for correcting the asymmetrical conditions in the rolling is known, for example, from U.S. Pat. No. 3,587,263. According to this known apparatus, difference in the rolling load between an operating side and a driving side of a rolling mill is determined. On the basis of the determined difference, a difference in the screw-down quantity or pressure between the opposite sides of the rolling mill as viewed in the widthwise direction of the rolled material (i.e. the operating side and the driving side) is arithmetically determined so that the rolling load difference becomes equal to zero by correspondingly controlling screw-down devices provided at opposite sides of the rolling mill through a screw-down command device. This control system is based on the discovered fact that the rolling asymmetry is ascribable to asymmetrical load distribution in the widthwise direction of the material to be rolled. Accordingly, when the screw-down pressure at the opposite sides of the rolling mill is so adjusted that the rolling load difference becomes equal to zero, the asymmetrical condition is thereby correctively compensated.

However, when the rolling asymmetry correcting apparatus is applied as it is to a rolling mill such as a six-high mill as mentioned above, it has been found that a serious inconvenience is involved. Namely, displacement of the intermediate rolls which is inherently intended for correcting the asymmetrical condition gives rise to occurrence of disturbance in the less asymmetrical rolling condition, to thereby involve much more serious asymmetry in the rolling condition as being accompanied by corresponding degradation in the quality of the rolled product. To evade such difficulty, the displacement of the intermediate rolls is inhibited so long as the asymmetry correcting control loop is actuated, whereby inadequency is involved in the profile controlling capability. When the profile quality becomes considerably deteriorated, the asymmetry correcting control loop must be broken, during which the profile of the material being rolled has to be manually controlled by operator, resulting of course in a poor manipulatability of the rolling mill system.

An object of the invention is therefore to provide a method and an apparatus for correcting asymmetrical conditions in a rolling mill which is insusceptible to the influence of the displacement of intermediate rolls and can assure a rolling operation in a stable manner with the asymmetrical conditions being automatically removed and without involving disdavantages of the hitherto known apparatus such as described above.

In view of the above and other objects which will become apparent as description proceeds, it is proposed according to an aspect of the invention that rolling load change components due to a moment produced upon axial displacement of rolls in a rolling mill is eliminated from difference in the rolling load between an operating side and a driving side of the rolling mill, to thereby determine a real rolling load difference on the basis of which asymmetrical conditions are corrected.

The above and other objects, features and advantages of the invention will become more apparent from the following description on preferred embodiments of the invention taken in conjunction with the accompanying drawings, in which.

Figure 3:
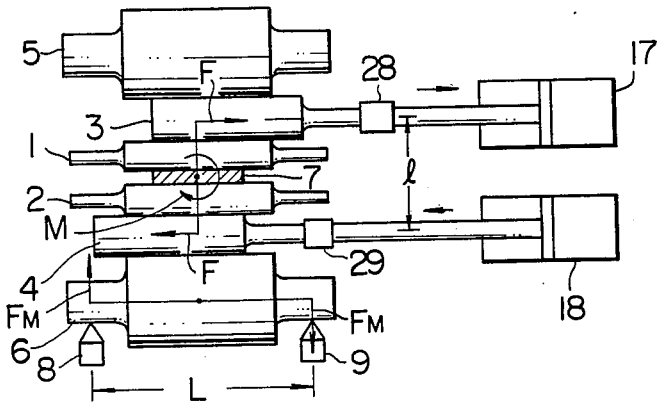
FIG. 3 is a view to illustrate generation of a moment in the rolling mill due to the shifting of the movable rolls.
Figure 6:
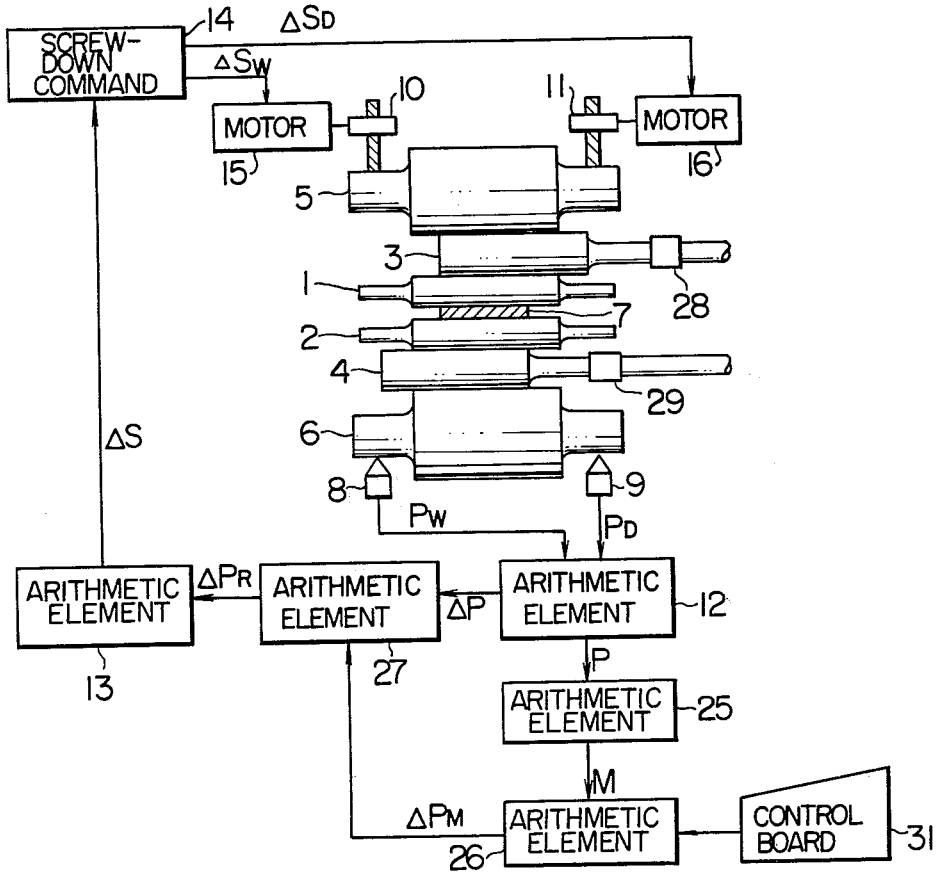
Figure 4:
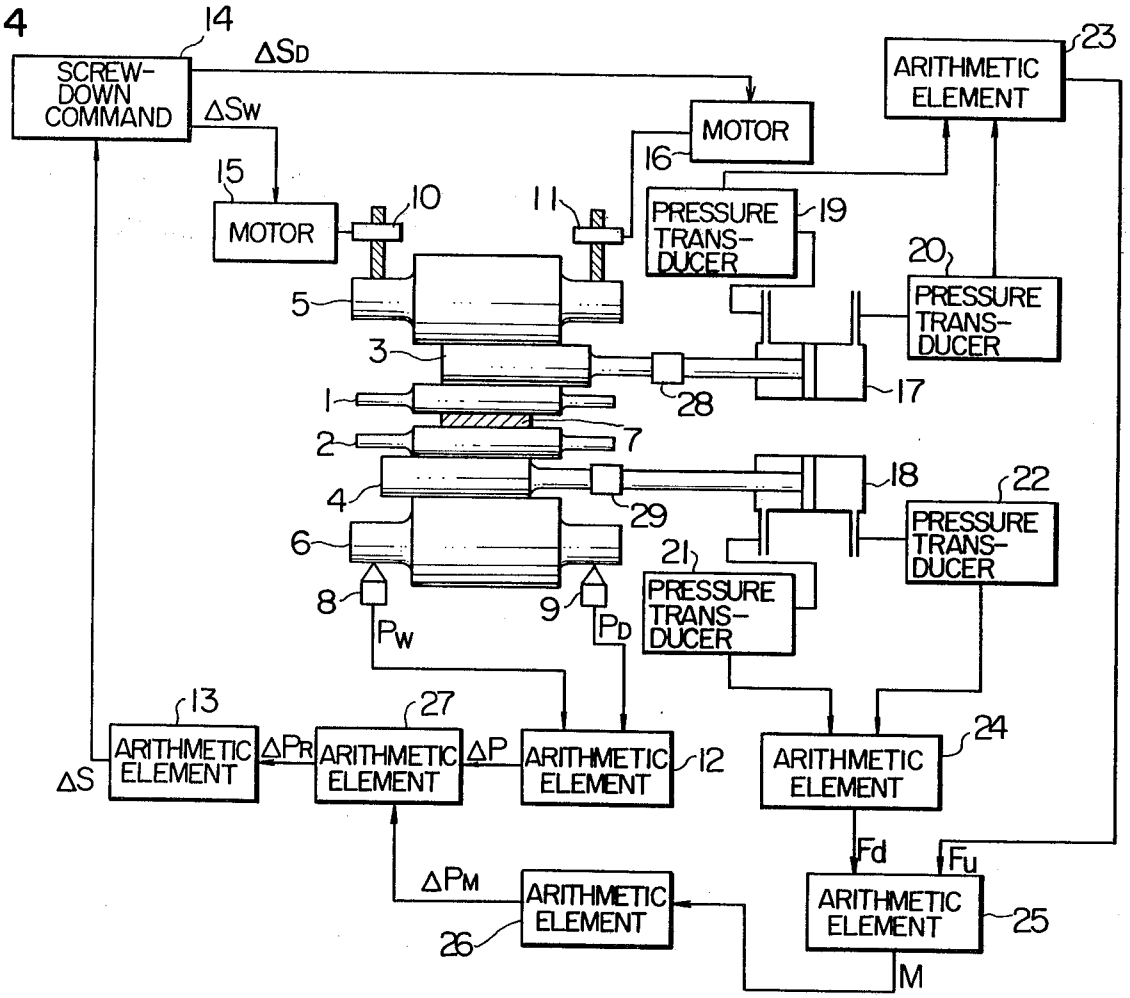
Figure 5:
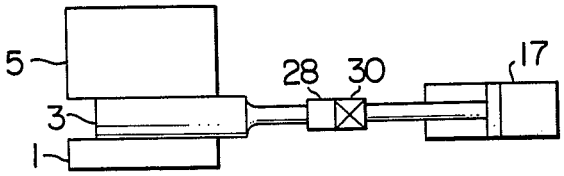
Figure 7:
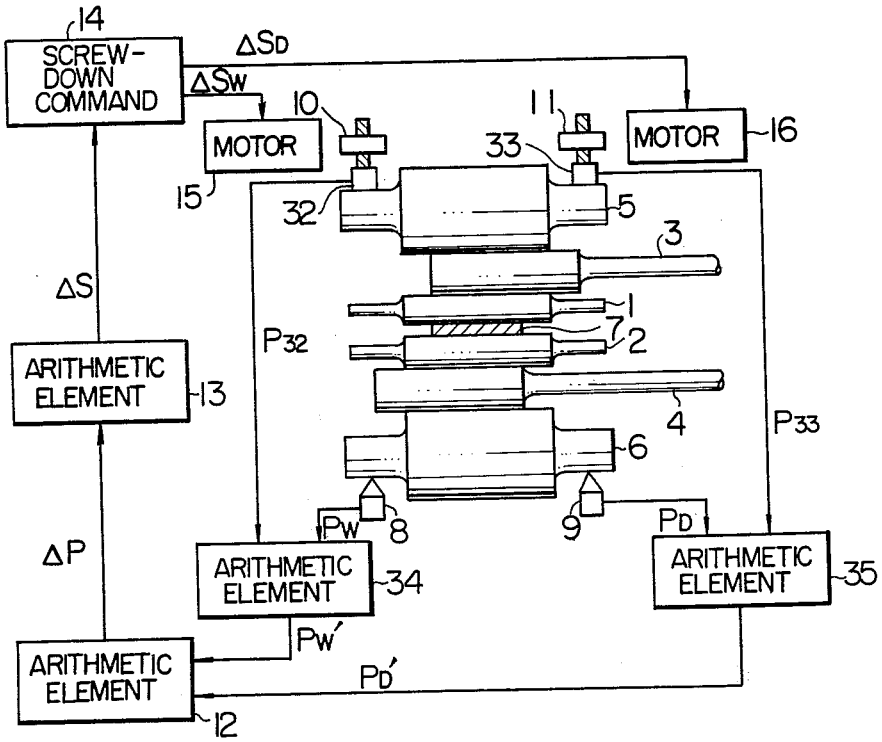
Figure 8:
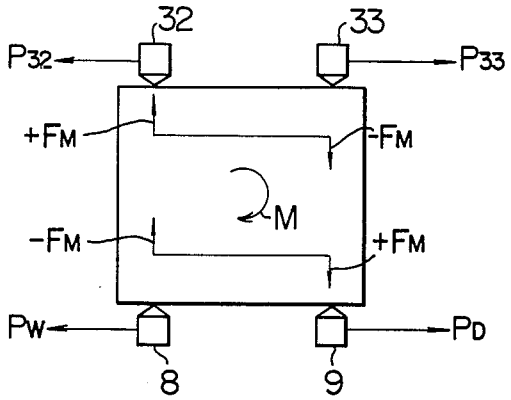
Figure 9:
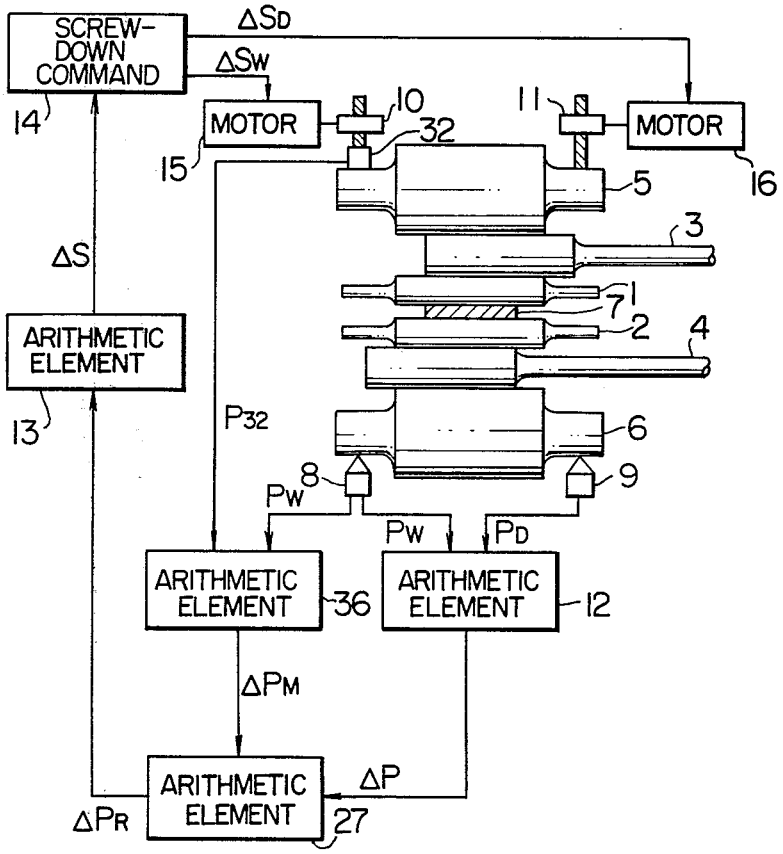

FIG. 4 drawn in the next sheet shows an arrangement of a rolling mill according to an embodiment of the invention;

FIG. 5 is a view to illustrate another method of measuring a force produced for the displacement of the movable roll;

FIG. 6 drawn in as that of FIG. 3 shows a further embodiment of the rolling mill according to the invention;

FIG. 7 drawn in the same sheet as that of FIG. 5 shows a still further embodiment of the rolling mill according to the invention;

FIG. 8 is a schematic diagram to illustrate occurrence of a pressure difference due to generation of a moment; and FIG. 9 shows still another embodiment of the invention.

Prior to the detailed description of the preferred embodiments of the invention, the shortcomings of the prior art rolling mill reviewed briefly hereinbefore will be further discussed by referring to the drawings, in order to have a better understanding of the invention.

Figure 1:
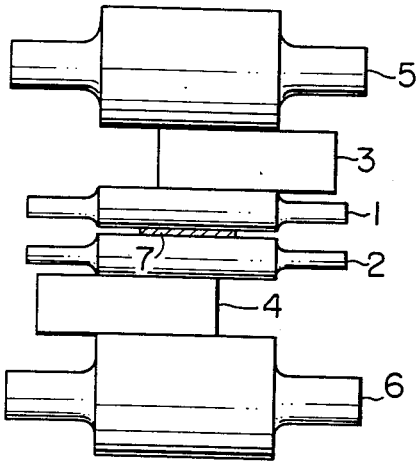
FIG. 1 shows a rolling mill which has rolls movable in the longitudinal direction thereof and to which the invention is applied.
Figure 2:
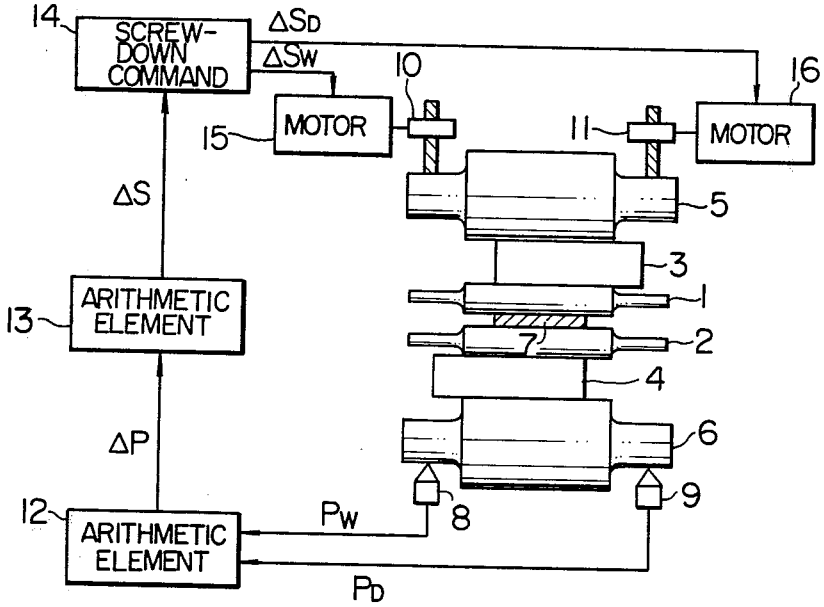
FIG. 2 PRIOR ART
FIG. 2 is a view to illustrate a hitherto known asymmetry correcting apparatus.

Referring to FIG. 1 which shows a typical one of the modern rolling mills described hereinbefore, the rolling mill comprises work rolls 1 and 2, back-up rolls 5 and 6 and intermediate rolls 3 and 4 each of which is interposed between the work roll and the back-up roll, wherein the intermediate rolls are adapted to be adjustably displaced or shifted in the longitudinal or axial direction thereof in dependence on width and cross-sectional configuration or profile of a material 7 to be rolled, thereby to increase a controlling or correcting capability of the roll bending device. FIG. 2 shows a control system for the rolling mill disclosed in U.S. Pat. No. 3,587,263 as mentioned above. Signals $P_W$ and $P_D$ produced from load transducers or cells 8 and 9 which are provided at so-called operating side and driving side of the rolling mill, respectively, are supplied to an arithmetic element 12 which is adapted to arithmetically determine a load or pressure difference $\Delta P$ between the signal quantities $P_W$ and $P_D$. The output signal $\Delta P$ from the arithmetic element 12 is then fed to an arithmetic element 13 which is operative to calculate a difference $\Delta S$ between rolling forces applied by screw down devices 10 and 11 such that the load difference $\Delta P$ is equal to zero. The difference signal $\Delta S$ is supplied to a screw-down command apparatus 14 which controls screw-down motors 15 and 16 connected to the screw down devices 10 and 11 provided at the operating and the driving sides of the rolling mill. It has been found that when the control system illustrated in FIG. 2 is applied to the rolling mill shown in FIG. 1 as it is, there is involved the serious problems mentioned briefly hereinbefore, the reason for which will be described below in some detail.

For shifting the intermediate rolls 3 and 4, forces F of the same magnitude are applied in the opposite directions to the intermediate rolls 3 and 4 by associated driving devices such as rams 17 and 18 through joints 28, 29 in order to assure the symmetry in the distribution of rolling pressure, as is illustrated in FIG. 3. These shifting forces F form a couple relative to the geometrical center of the rolling mill to thereby generate a moment M which can be expressed as follows:

$$M=F.l \tag{1}$$

where l represents a distance between the center axes of the intermediate rolls 3 and 4. Under the circumstances, the load cells 8 and 9 will sense a force $F_M$ due to the moment M, resulting in that a corresponding load difference $\Delta P_M$ is detected. This load difference $\Delta P_M$ ascibable to the moment M can be mathematically expressed as follows:

$$\Delta P_M=2.F_M=2M/L \tag{2}$$

where L represents the distance between the load cells 8 and 9. In this connection, it should be noted that the symmetry is assured for the rolling action itself at this instant. Consequently, generation of the load difference $\Delta P_M$ will cause the arithmetic element 13 to decide erroneously that asymmetrical rolling takes place, whereby the difference $\Delta S$ in the rolling force is arithmetically determined by the arithmetic element 13 shown in FIG. 2, involving erroneous control for the screw-down devices 10 and 11 provided at the operating and the driving sides of the rolling mill to the serious disadvantage described hereinbefore.

FIG. 4 shows a rolling mill according to a preferred embodiment of the invention. In the figure, numerals 19, 20, 21 and 22 denote pressure transducers. A shifting force $F_u$ applied to the upper intermediate roll 3 is determined by multiplying a difference signal between the outputs from the pressure transducers 19 and 20 with effective piston area of a hydraulic cylinder 17. In a similar manner, the shifting force $F_d$ applied to the lower intermediate roll 4 corresponds to a product of a difference signal derived from the pressure transducers 21 and 22 and the effective piston area of a hydraulic cylinder 18. Arithmetic operations for determining the shifting forces $F_u$ and $F_d$ are executed by arithmetic elements 23 and 24. From the forces $F_u$ and $F_d$, an arithmetic element 25 determines a moment M in accordance with the following expression:

$$M=\frac{F_u+F_d}{2}\cdot l \tag{3}$$

where l represents a distance between the center axes of the intermediate rolls 3 and 4.

The output from the arithmetic element 25 is supplied to a succeeding arithmetic element 26 which then determines the load difference $\Delta P_M$ in accordance with the expression (2). On the other hand, the rolling loads $P_W$ and $P_D$ are detected by the load cells 8 and 9 provided at the operating and the driving sides of the rolling mill, whereby the load difference $\Delta P$ is arithmetically determined by the arithmetic element 12 in accordance with the following expression:

$$\Delta P=P_W-P_D \tag{4}$$

Since the load difference $\Delta P_M$ due to the moment M described above plays no part in the asymmetrical distribution of the rolling pressure, this quantity has to be subtracted from the load difference $\Delta P$. To this end, an arithmetic element 27 is provided for determining from the difference between $\Delta P$ and $\Delta P_M$ a real load difference $\Delta P_R$ which is ascrible to the real asymmetry in the rolling. Namely, $$\Delta P_R=\Delta P-\Delta P_M \tag{5}$$

From the real load difference $\Delta P_R$, the arithmetic element 13 determines the screw-down pressure difference $\Delta S$ for correcting the prevailing asymmetry. In this way, the rolling asymmetry can be corrected without being subjected to disturbing influences due to the moment M of the intermediate rolls.

The invention can be applied to other known types of the rolling asymmetry correcting systems in which the load difference sensed at the opposite sides (i.e. operating side and driving side) of the rolling mill is made use of as a signal for correcting the rolling asymmetry such as a case where the load difference appearing across the opposite sides of a rolling mill is utilized for controlling the roll bending forces applied at the operating and the driving sides, for example. Further, the pressure transducers 19; 20 (or 21; 22) may be replaced by a load cell 30 directly mounted between a joint 28 and the associated hydraulic cylinder 17 for detecting the shifting force F, as is illustrated in FIG. 5. Besides, the force F for shifting or displacing the intermediate roll can be determined without resorting to the use of the pressure transducer or load cell. In other words, the force F required for displacing the intermediate roll is determined on the basis of the following formula:

$$F=\mu \cdot P_F \quad (6)$$

where $P_F$ represents a force under which the intermediate roll is pressed by the associated work roll and back-up roll, and $\mu$ represents frictional coefficient among these rolls. Since the force $P_F$ is nothing but the rolling load P, the force $P_F$ can be measured with the aid of the load cells 8 and 9. On the other hand, the frictional coefficient $\mu$ can be regarded as a constant which thus may be measured once by a load cell mounted in a manner shown in FIG. 5 and present for subsequent use.

FIG. 6 shows a preferred embodiment of the rolling mill constructed on the principle described above. Sum and difference signals of the signals $P_W$ and $P_D$ available from the load cells 8 and 9 are determined by an arithmetic element 12 to calculate the rolling load P and the load difference $\Delta P$. An arithmetic element 25 arithmetically determines the moment M from the rolling load P and the frictional coefficient $\mu$ preset as a constant in accordance with the equation (6). Another arithmetic element 26 is adapted to arithmetically determine the load difference component $\Delta P_M$ ascribable to the moment M as described hereinbefore. In this connection, it is to be noted that the arithmetic element 26 supplies the load difference component $\Delta P_M$ to an arithmetic element 27 only when the arithmetic element 26 receives from a control panel 31 the signal informing that the intermediate roll is being displaced. The arithmetic element 27 determines the real load difference on the basis of which the asymmetry correcting control is performed in a similar manner as described hereinbefore. The embodiment described just above is advantageous in that special means need not be provided for measuring the force for shifting the intermediate rolls.

FIG. 7 shows another preferred embodiment of the rolling mill according to the invention which is based on the concept that load detectors located at two arbitrary points are sufficient for detecting the moment M. To this end, load cells 32 and 33 similar to the cells 8 and 9 are disposed below screws of the screw-down devices 10 and 11, respectively. Since the moment is produced relative to the geometrical center of the rolling mill, the load difference appearing between the load cells 8 and 9 is symmetrical to the load difference appearing between the load cells 32 and 33. Such symmetrical relationship is schematically illustrated in FIG. 8. Assuming that the distance between the load cells 8 and 9 is equal to the distance between the cells 32 and 33, the load difference component $\Delta P_M$ ascribable to the moment M is sensed as $+F_M$, $-F_M$, $-F_M$ and $+F_M$ at the load cells 32, 33, 8 and 9, respectively (refer to FIG. 8). Accordingly, when the outputs from the load cells which are disposed at the same side, i.e. cells 8 and 32; cells 9 and 33, are averaged, the forces $F_M$ are cancelled to each other. To this end, an arithmetic element 34 is provided to average the outputs $P_W$ and $P_{32}$ respectively, produced from the load cells 8 and 32 on one hand, while an arithmetic element 35 is provided for averaging the respective outputs $P_D$ and $P_{33}$ from the load cells 9 and 33, respectively, in accordance with the following expressions:

$$P_W'=\tfrac{1}{2}(P_W+P_{32}) \quad (7)$$

$$P_D'=\tfrac{1}{2}(P_D+P_{33}) \quad (8)$$

The asymmetry correcting control is then effected in accordance with the quantities $P_W'$ and $P_D'$ thus determined.

Further, a modification of the embodiment shown in FIG. 7 is conceivable in consideration of the fact that the output signals $P_W$ and $P_{32}$ of the load cells 8 and 32 (FIG. 8) change by $+F_M$ and $-F_M$ when moment M is produced. Accordingly, $$P_{32}-P_W=2F_M=\Delta P_M \quad (9)$$

Thus, the load difference component $\Delta P_M$ due to the moment M can be determined as follows:

$$\Delta P_M=P_{32}-P_W \quad (10)$$

Once the quantity $\Delta P_M$ is determined, the succeeding procedures are executed in the same manner as described hereinbefore. A preferred embodiment based on the above concept is shown in FIG. 9. An arithmetic element 36 executes the calculation for determining $\Delta P_M$ in accordance with the equation (10) from the output signals of the load cells 8 and 32 disposed at the same side of the rolling mill. On the other hand, the real load difference $\Delta P_R$ is determined by the arithmetic element 27 from the load difference $\Delta P$ appearing across the load cells 8 and 9 and the load change component $\Delta P_M$ due to the moment M, to thereby effect the asymmetry correcting control. The embodiment shown in FIG. 9 involves an advantage that addition of a single load cell to an existing equipment is sufficient.

Although the invention has been described in conjunction with the exemplary embodiments shown in the drawings, it will be appreciated that many modifications and variations will readily occur to those skilled in the art without departing from the spirit and scope of the invention. For example, although it has been assumed in the foregoing description that the invention is applied to a six-high mill in which a pair of upper and lower intermediate rolls are axially movable, the invention will never be restricted to such rolling mill, but can be applied to other types of rolling mills so far as any rolls inclusive of the work rolls or the back-up rolls are moved in the axial directions during the rolling operation.

From the foregoing, it will be understood that the present invention brings about many advantages. For example, erroneous operations occurring upon roll displacement for the asymmetry correction operation in the hitherto known apparatus can be positively suppressed, whereby stable rolling operation can be assured without incurring degradation in the quality of the rolled product. Further, complicated procedures for breaking interchangeably the control loops upon the roll shiftings are rendered unnecessary.

What we claim is:

1. A method of correcting asymmetrical condition in a rolling mill in which predetermined rolls are displaced in the respective axial direction thereof during rolling operation, comprising steps of determining a real rolling load difference by eliminating rolling load change components due to a moment produced upon axial displacement of said rolls from a rolling load difference appearing across an operating side and a driving side of said rolling mill, and correcting said asymmetrical condition on the basis of said real rolling load difference.

2. A method of correcting asymmetrical condition in a rolling mill according to claim 1, wherein said rolling load change components due to the moment produced upon displacement of the rolls in the respective axial directions thereof are arithmetically determined from detected forces for displacing said rolls in the respective axial directions thereof.

3. A method of correcting asymmetrical condition in a rolling mill according to claim 1, wherein said rolling load change components due to the moment produced upon displacement of the roll in the respective axial directions thereof is arithmetically determined from detected reacting forces due to said moment.

4. In a rolling mill in which predetermined rolls are displaced in the axial directions thereof during rolling operation, an apparatus for correcting asymmetrical condition in said rolling mill by adjusting selected one of screw-down quantity and roll being quantity at operating and driving sides of said rolling mill on the basis of a rolling load difference appearing across said operating and driving sides, said apparatus comprising means for detecting and arithmetically determining rolling load change components due to a moment produced upon displacement of said rolls, means for detecting and arithmetically determining a rolling load difference appearing across the operating and driving sides of said rolling mill, and means for arithmetically determining a real rolling load difference by eleminating said rolling load change components due to said moment from said rolling load difference, said real rolling load difference being utilized to correct the asymmetrical condition.

5. An apparatus according to claim 4, wherein said means for detecting and arithmetically determining the rolling load change components due to said moment includes means for detecting a force for moving said rolls in the respective axial directions thereof, and means for arithmetically determining said rolling load change components from said detected roll moving force.

6. An apparatus according to claim 4, wherein said means for detecting and arithmetically determining the rolling load change components due to said moment includes means for detecting a reacting force due to said moment, and means for arithmetically determining the rolling load change components from the detected reacting force.

* * * * *